United States Patent [19]

Otsuka et al.

[11] 4,393,842

[45] Jul. 19, 1983

[54] AIR/FUEL RATIO CONTROL SYSTEM FOR INTERNAL COMBUSTION ENGINES, HAVING ATMOSPHERIC PRESSURE COMPENSATING FUNCTION

[75] Inventors: Kazuo Otsuka, Higashikurume; Shin Narasaka, Yono; Shumpei Hasegawa, Niiza, all of Japan

[73] Assignee: Honda Motor Co., Ltd., Tokyo, Japan

[21] Appl. No.: 286,880

[22] Filed: Jul. 27, 1981

[30] Foreign Application Priority Data

Jul. 28, 1980 [JP] Japan ..... 55-103315

[51] Int. Cl.[3] ..... F02B 33/00

[52] U.S. Cl. ..... 123/440; 123/489; 123/479; 123/486; 123/465

[58] Field of Search ..... 123/440, 463, 465, 489, 123/479, 486

[56] References Cited

U.S. PATENT DOCUMENTS

| | | | |
|---|---|---|---|
| 4,060,064 | 11/1977 | Minami et al. | 123/440 |
| 4,170,201 | 10/1979 | Camp et al. | 123/489 |
| 4,172,432 | 10/1979 | Wessel et al. | 123/440 |
| 4,187,814 | 2/1980 | Phelan et al. | 60/276 |
| 4,245,603 | 1/1981 | Pomerantz | 123/440 |
| 4,269,156 | 5/1981 | Drellishak | 123/440 |
| 4,289,103 | 9/1981 | Shinoda | 123/440 |
| 4,294,216 | 10/1981 | Abo et al. | 123/440 |

*Primary Examiner*—Parshotam S. Lall

*Attorney, Agent, or Firm*—Arthur L. Lessler

[57] ABSTRACT

An air/fuel ratio control system for use with an internal combustion engine. The system is provided with an electrical circuit which operatively connects an $O_2$ sensor with fuel quantity adjusting means in a manner effecting feedback control of the air/fuel ratio of a mixture produced by the fuel adjusting means and being supplied to the engine in response to the output signal of the $O_2$ sensor. The electrical circuit includes means operable during open loop control of the air/fuel ratio under a particular engine operating condition, for controlling the fuel quantity adjusting means so as to obtain a mixture having a predetermined air/fuel ratio appropriate for the particular engine operating condition, irrespective of the $O_2$ sensor output signal, and means for correcting the above predetermined ratio in response to atmospheric pressure. The electrical circuit further comprises fail safe means for detecting a malfunction in the atmospheric pressure sensor. The fail safe means is operable upon detection of such a malfunction to perform suitable fail safe functions including prevention of the mixture air/fuel ratio from being controlled to an inappropriate value even during the occurrence of the malfunction.

6 Claims, 2 Drawing Figures

20
37
38
36
29
34
35
28
27
33
31
32
39
1
2
3
4
5
6
$3_1$
$3_2$
$30_1$
$30_2$
$7_1$
$7_2$
$8_1$
$8_2$
$8_3$
$8_4$
40
9
10
10a
11
11a
12
13
14
15
16
17
18
21
22
23
24
25
26

AIR/FUEL RATIO CONTROL SYSTEM FOR INTERNAL COMBUSTION ENGINES, HAVING ATMOSPHERIC PRESSURE COMPENSATING FUNCTION

BACKGROUND OF THE INVENTION

This invention relates to an air/fuel ratio control system for performing feedback control of the air/fuel ratio of a mixture being supplied to an internal combustion engine, and more particularly to a device provided in the above system for correcting the position of a pulse motor used as an actuator for driving an air/fuel ratio control valve, during open loop control as a function of atmospheric pressure.

A system has already been proposed e.g. by the assignee of the present application, which includes an $O_2$ sensor for detecting the concentration of oxygen present in the exhaust gases emitted from an internal combustion engine, fuel quantity adjusting means including a carburetor and operable to produce the mixture being supplied to the engine, and means operatively connecting the $O_2$ sensor with the fuel quantity adjusting means in a manner effecting feedback control operation in response to an output signal produced by the $O_2$ sensor to control the air/fuel ratio of the mixture to a preset value. The connecting means comprises an electrical circuit, an air/fuel ratio control valve, a pulse motor for driving the control valve, etc.

According to the above conventional air/fuel ratio control system, if the above feedback control operation is conducted in response to the output signal of the $O_2$ sensor when the engine is under particular operating conditions (the start of the engine, wide-open-throttle, idle, deceleration, and acceleration at the standing start of the engine), often the air/fuel ratio is not controlled to a proper or desired value. Therefore, to achieve a proper or desired air/fuel ratio even under such a particular engine operating condition, it is necessary to relieve the air/fuel ratio control system of its closed loop mode where the air/fuel ratio control is carried out, and effect air/fuel ratio control in open loop mode upon the occurrence of the particular engine operating condition to drive the pulse motor to a predetermined preset position appropriate respectively for the particular engine operating condition.

During such open loop control, the air/fuel ratio of the mixture is kept at a predetermined constant value corresponding to the above predetermined preset position of the pulse motor. However, if there is a change in the ambient atmospheric pressure, the air/fuel ratio obtained does not have a proper value appropriate for the particular engine operating condition concerned, resulting in inferior engine performance.

In addition, the above predetermined preset position to which the pulse motor is set during open loop control under the particular engine condition form an initial pulse motor position with which closed loop control is initiated immediately following the open loop control. Therefore, to obtain optimum exhaust gas emission characteristics during the above open loop control and during transition from the open loop control to the closed loop control irrespective of changes in the ambient atmospheric pressure, the pulse motor position has to be compensated for changes in the ambient atmospheric pressure during open loop control.

OBJECTS AND SUMMARY OF THE INVENTION

It is a primary object of the invention to provide an air/fuel ratio control system for use with an internal combustion engine, which is provided with a function of correcting predetermined preset values of the pulse motor position in a linear manner in response to changes in the ambient atmospheric pressure during open loop control under particular engine operating conditions so as to achieve air/fuel ratios best suited for the respective particular engine operating conditions. With the above atmospheric pressure compensating function, it is not only possible to obtain conventionally known effects of good driveability and prevention of burning of the ignition plug but also set the pulse motor position during the open loop control at a value also appropriate for initiation of the subsequent closed loop control, to thereby achieve optimum engine emission characteristics.

It is a further object of the invention to provide an air/fuel ratio control system for use with an internal combustion engine, which is provided with a fail safe function for coping with a trouble (i.e., a malfunction) in an atmospheric pressure sensor used in the system and its related parts. The function includes preventing the air/fuel ratio of the mixture from having an improper value upon occurrence of such a trouble.

According to the invention, there is provided an air/fuel ratio control system for performing feedback control of the air/fuel ratio of a mixture being supplied to an internal combustion engine, which comprises an $O_2$ sensor for detecting the concentration of oxygen present in exhaust gases emitted from the engine, fuel quantity adjusting means for producing the mixture being supplied to the engine, and an electrical circuit operatively connecting the $O_2$ sensor with the fuel quantity adjusting means in a manner effecting feedback control operation in response to an output signal produced by the $O_2$ sensor to control the air/fuel ratio of the mixture to a first predetermined preset value. The electrical circuit includes means for interrupting the air/fuel ratio feedback control operation when the engine comes into a predetermined operating condition, means responsive to the interruption of the feedback control operation to control said fuel quantity adjusting means so as to obtain an air/fuel ratio of the mixture equal to a second predetermined preset value corresponding to said predetermined engine operating condition irrespective of the value of the output signal of the $O_2$ sensor, and means for correcting the above second predetermined preset value as a function of atmospheric pressure.

Further, the electrical circuit is provided with a fail safe function of producing a first signal when the value of actual atmospheric pressure becomes out of a predetermined range, to allow continuation of the air/fuel ratio control operation by the use of the value of actual atmospheric pressure occurring immediately before the occurrence of the first signal, and producing a second signal when the occurrence of the first signal is continued for a predetermined period of time, to carry out predetermined fail safe actions.

The above and other objects, features and advantages of the invention will be more apparent from the ensuing detailed description taken in connection with the accompanying drawings in which:

DETAILED DESCRIPTION

The air/fuel ratio control system according to the invention will now be described in detail with reference to the accompanying drawings wherein an embodiment of the invention is illustrated.

Figure 1:
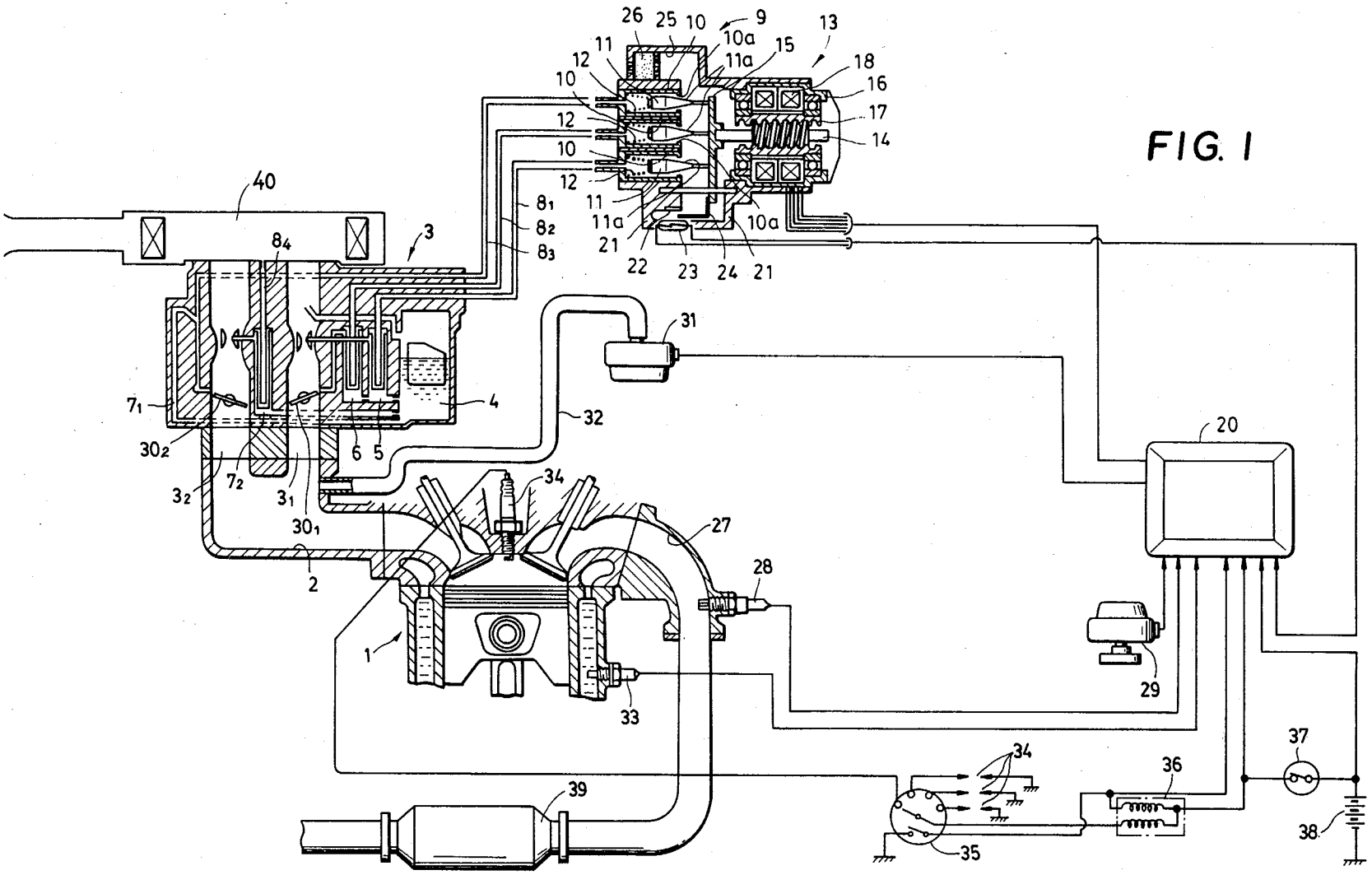
FIG. 1 is a diagrammatic view illustrating an embodiment of the air/fuel ratio control system according to the present invention.

Referring now to FIG. 1, there is illustrated the whole system of the invention. Reference numeral 1 designates an internal combustion engine. Connected to the engine 1 is an intake manifold 2 which is provided with a carburetor generally designated by the numeral 3. The carburetor 3 has fuel passages 5, 6 which communicate a float chamber 4 with the primary bore $3_1$ of the carburetor 3. These fuel passages 5, 6 are connected to an air/fuel ratio control valve generally designated by the numeral 9, via air bleed passages $8_1$, $8_2$. The carburetor 3 also has fuel passages $7_1$, $7_2$ communicating the float chamber 4 with the secondary bore $3_2$ of the carburetor 3. The fuel passage $7_1$, on one hand, is connected to the above air/fuel ratio control valve 9 via an air passage $8_3$ and, on the other hand, opens in the secondary bore at a location slightly upstream of a throttle valve $30_2$ in the secondary bore. The fuel passage $7_2$ communicates with the interior of an air cleaner 40 via an air passage $8_4$ having a fixed orifice. The control valve 9 is comprised of three flow rate control valves, each of which is formed of a cylinder 10, a valve body 11 displaceably inserted into the cylinder 10, and a coil spring 12 interposed between the cylinder 10 and the valve body 11 for urging the valve body 11 in a predetermined direction. Each valve body 11 is tapered along its end portion 11*a* remote from the coil spring 12 so that the effective opening area of the opening 10*a* of each cylinder 10, in which the tapered portion 11*a* of the valve body is inserted, varies as the valve body 11 is moved. Each valve body 11 is disposed in urging contact with a connection plate 15 coupled to a worm element 14 which is axially movable but not rotatable about its own axis. The worm element 14 is in threaded engagement with the rotor 17 of a pulse motor 13 which is arranged about the element 14 and rotatably supported by radial bearings 16. Arranged about the rotor 17 is a solenoid 18 which is electrically connected to an electronic control unit (hereinafter called "ECU") 20. The solenois 18 is energized by driving pulses supplied from ECU 20 to cause rotation of the rotor 17 which in turn causes movement of the worm element 14 threadedly engaging the rotor 17 in the leftward and rightward directions as viewed in FIG. 1. Accordingly, the connection plate 15 coupled to the worm element 14 is moved leftward and rightward in unison with the movement of the worm element 14.

The pulse motor 13 has its stationary housing 21 provided with a permanent magnet 22 and a reed switch 23 arranged opposite to each other. The plate 15 is provided at its peripheral edge with a magnetic shielding plate 24 formed of a magnetic material which is interposed between the permanent magnet 22 and the reed switch 23 for movement into and out of the gap between the two members 22, 23. The magnetic shielding plate 24 is displaced in the leftward and rightward directions in unison with displacement of the plate 15 in the corresponding directions. The reed switch 23 turns on or off in response to the displacement of the plate 24. That is, when the valve body 11 of the air/fuel ratio control valve 9 passes a reference position which is determined by the positions of the permanent magnet 22, reed switch 23 and magnetic shielding plate 24, the reed switch 23 turns on or off depending upon the moving direction of the valve body 11, to supply a corresponding binary output signal to ECU 20.

Incidentally, the pulse motor housing 21 is formed with an air intake 25 communicating with the atmosphere. Air is introduced through a filter 26 mounted in the air intake 25, into each flow rate control valve in the housing 21.

On the other hand, an $O_2$ sensor 28, which is made of stabilized zirconium oxide or a like material, is mounted in the inner wall of the exhaust manifold 27 of the engine 1 in a manner projecting into the manifold 27, an output of which is supplied to ECU 20. Further, an atmospheric pressure sensor 29 is arranged to detect the atmospheric pressure surrounding the vehicle in which the engine is installed, an output of which is supplied to ECU 20, too.

Incidentally, in FIG. 1, reference numeral 39 designates a three-way catalyst for purifying CO, HC and NOx in the exhaust gases emitted from the engine 1, 31 a pressure sensor arranged to detect suction pressure in the intake air manifold 2 at a zone downstream of the throttle valves $30_1$, $30_2$ through a conduit 32, and an output of which is supplied to ECU 20, too, 33 a thermistor partly inserted in the peripheral wall of the engine cylinder the interior of which is filled with engine cooling water for detecting the cooling water temperature representing the engine temperature, 34 an ignition plug, 35 a distributor, 36 ignition coil, 37 an ignition switch, and 38 a car battery, respectively. The distributor 35 has a drive shaft, not shown, arranged for rotation at a speed proportional to the speed of the engine, to cause a flow of current in the form of pulses through the ignition coil 36, which corresponds in frequency to the output signal of interrupting action of the contact breaker or contactless pickup of the distributor. This current is supplied to ECU 20, too. Therefore, in the illustrated embodiment, the distributor 35 and the ignition coil 36 also serve as an engine rpm sensor.

Details of the air/fuel ratio control which can be performed by the air/fuel ratio control system according to the invention will now be described by further reference to FIG. 1 which has been referred to hereinabove.

INITIALIZATION

Referring first to the initialization, when the ignition switch 37 in FIG. 1 is set on, ECU 20 is initialized to detect the reference position of the actuator or pulse motor 13 by means of the reed switch 23 and hence drive the pulse motor 13 to set it to its best position (a preset position) for starting the engine, that is, set the initial air/fuel ratio to a predetermined proper value. The above preset position of the pulse motor 13 is hereinafter called "$PS_{CR}$." This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idling rpm.

The above reference position of the pulse motor 13 is detected as the position at which the reed switch 23 turns on or off, as previously mentioned with reference to FIG. 1.

Then, ECU 20 monitors the condition of activation of the $O_2$ sensor 28 and the coolant temperature Tw detected by the thermistor 33 to determine whether or not the engine is in a condition for initiation of the air/fuel ratio control. For accurate air/fuel ratio feedback control, it is a requisite that the $O_2$ sensor 28 is fully activated and the engine is in a warmed-up condition. The $O_2$ sensor, which is made of stabilized zirconium dioxide or the like as previously mentioned, has a characteristic that its internal resistance decreases as its temperature increases. If the $O_2$ sensor is supplied with electric current through a resistance having a suitable resistance value from a constant-voltage regulated power supply provided within ECU 20, the electrical potential or output voltage of the sensor initially shows a value close to the power supply voltage (e.g., 5 volts) when the sensor is not activated, and then, its electrical potential lowers with the increase of its temperature. Therefore, according to the invention, the air/fuel ratio feedback control is not initiated until after the conditions are fulfilled that the sensor produces an activation signal when its output voltage lowers down to a predetermined voltage Vx (e.g., 0.5 volt), a timer finishes counting for a predetermined period of time $t_x$ (e.g., 1 minute) starting from the occurrence of the above activation signal, and the coolant temperature Tw increases up to a predetermined value Twx at which the automatic choke is opened to an opening for enabling the air/fuel ratio feedback control.

During the above stage of the detection of activation of the $O_2$ sensor and the coolant temperature Tw, the pulse motor 13 is held at its predetermined position $PS_{CR}$. The pulse motor 13 is driven to appropriate position in response to the operating condition of the engine after initiation of the air/fuel ratio control, as hereinlater described.

BASIC AIR/FUEL RATIO CONTROL

Following the initialization, the program proceeds to the basic air/fuel ratio control.

ECU 20 is responsive to various detected value signals representing the output voltage of the $O_2$ sensor 28, the absolute pressure in the intake manifold 2 detected by the pressure sensor 31, the engine rpm Ne detected by the rpm sensor 35, 36, and the atmospheric pressure $P_A$ detected by the atmospheric pressure sensor 29, to drive the pulse motor 13 as a function of these signals to control the air/fuel ratio. More specifically, the basic air/fuel ratio control comprises open loop control which is carried out at wide-open-throttle, at engine idle, and at engine deceleration, and closed loop control which is carried out at engine partial load. All the control is initiated after completion of the warming-up of the engine.

First, the condition of open loop control at wide-open-throttle is met when the differential pressure $P_A-P_B$ (gauge pressure) between the absolute pressure $P_B$ detected by the pressure sensor 31 and the atmospheric pressure $P_A$ (absolute pressure) detected by the atmospheric pressure sensor 29 is lower than a predetermined value $P_{WOT}$. ECU 20 compares the difference in value between the output signals of the sensors 29, 31 with the predetermined value $\Delta P_{WOT}$ stored therein, and when the relationship of $P_A-P_B<\Delta P_{WOT}$ stands, drives the pulse motor 13 to a predetermined position (preset position) $PS_{WOT}$ and holds it there, which is a position best appropriate for the engine emissions to be obtained at the time of termination of the wide-open-throttle open loop control. At wide-open-throttle, a known economizer, not shown, or the like is actuated to supply a rich or small air/fuel ratio mixture to the engine.

The condition of open loop control at engine idle is met when the engine rpm Ne is lower than a predetermined idle rpm $N_{IDL}$ (e.g., 1,000 rpm). ECU 20 compares the output signal value Ne of the rpm sensor 35, 36 with the predetermined rpm $N_{IDL}$ stored therein, and when the relationship of $Ne<N_{IDL}$ stands, drives the pulse motor 13 to a predetermined idle position (preset position) $PS_{IDL}$ which is best suitable for the engine emissions and holds it there.

The above predetermined idle rpm $N_{IDL}$ is set at a value slightly higher than the actual idle rpm to which the engine concerned is adjusted.

The condition of open loop control at engine deceleration is fulfilled when the absolute pressure $P_B$ in the intake manifold is lower than a predetermined value $PB_{DEC}$. ECU 20 compares the output signal value $P_B$ of the pressure sensor 31 with the predetermined value $PB_{DEC}$ stored therein, and when the relationship of $P_B<PB_{DEC}$ stands, drives the pulse motor 13 to a predetermined deceleration position (preset position) $PS_{DEC}$ best suitable for the engine emissions and holds it there.

The ground for this condition of open loop control at engine deceleration lies in that when the absolute pressure $P_B$ in the intake manifold drops below the predetermined value, unburned HC is produced at an increased rate in the exhaust gases, to make it impossible to carry out the air/fuel ratio feedback control based upon the detected value signal of the $O_2$ sensor with accuracy, thus failing to control the air/fuel ratio to a theoretical value. Therefore, according to the invention, the open loop control is employed, as noted bove, when the absolute pressure $P_B$ in the intake manifold detected by the pressure sensor 31 is smaller than the predetermined value $PB_{DEC}$, where the pulse motor is set to the predetermined position $PS_{DEC}$ best suitable for the engine emission obtained at the time of termination of the deceleration open loop control.

During operations of the above-mentioned open loop control a wide-open-throttle, at engine idle, at engine deceleration, the respective predetermined position $PS_{WOT}$, $PS_{IDL}$, $PS_{DEC}$ for the pulse motor 13 are compensated for atmospheric pressure $P_A$, as hereinlater described.

On the other hand, the condition of closed loop control at engine partial load is met when the engine is in an operating condition other than the above-mentioned open loop control conditions. During the closed loop control, ECU 20 performs selectively feedback control based upon proportional term correction (hereinafter called "P term control") and feedback control based upon integral term correction (hereinafter called "I term control"), in response to the engine rpm Ne detected by the engine rpm sensor 35, 36 and the output signal of the $O_2$ sensor 28. To be concrete, the integral term correction is used when the output voltage of the $O_2$ sensor 28 varies only at the higher level side or only at the lower level side with respect to a reference voltage Vref, wherein the position of the pulse motor 13 is corrected by an integral value obtained by integrating the value of a binary signal which changes in dependence on whether the output voltage of the $O_2$ sensor is at the higher level or at the lower level with respect to the predetermined reference voltage Vref, to thereby achieve stable and accurate position control of the pulse motor 13. On the other hand, when the output signal of the $O_2$ sensor changes from the higher level to the lower level or vice versa, the proportional term correction is carried out wherein the position of the pulse motor 13 is corrected by a value directly proportional to a change in the output voltage of the $O_2$ sensor to thereby achieve air/fuel ratio control in a manner prompter and more efficient than the integral term correction.

As noted above, according to the above I term control, the pulse motor position is varied by an integral value by integrating the value of a binary signal corresponding to the change of the output voltage of the $O_2$ sensor. According to this I term control, the number of steps by which the pulse motor is to be displaced per second differs depending upon the speed at which the engine is then operating. That is, in a low engine rpm range, the number of steps by which the pulse motor is to be displaced is small. With an increase in the engine rpm, the above number of steps increases so that it is large in a high engine rpm range.

Whilst, according to the P term control which, as noted above, is used when there is a change in the output voltage of the $O_2$ sensor from the higher level to the lower one or vice versa with respect to the reference voltage Vref, the number of steps by which the pulse motor is to be displaced per second is set at a single predetermined value (e.g., 6 steps), irrespective of the engine rpm.

The air/fuel ratio control at engine acceleration (i.e., off-idle acceleration) is carried out when the engine rpm Ne exceeds the aforementioned predetermined idle rpm $N_{IDL}$ during the course of the engine speed increasing from a low rpm range to a high rpm range, that is, when the engine speed changes from a relationship $Ne < N_{IDL}$ to one $Ne \geqq N_{IDL}$. On this occasion, ECU 20 rapidly moves the pulse motor 13 to a predetermined acceleration position (preset position) $PS_{ACC}$, and thereafter initiates the aforementioned air/fuel ratio feedback control. This predetermined position $PS_{ACC}$ is compensated for atmospheric pressure $P_A$, too, as hereinafter described.

The above-mentioned predetermined position $PS_{ACC}$ is set at a position where the amount of detrimental ingredients in the exhaust gases is small. Therefore, particularly at the so-called "standing start," i.e., acceleration from a vehicle-stopping position, setting the pulse motor position to the predetermined position $PS_{ACC}$ is advantageous to anti-exhaust measures, as well as to achievement of accurate air/fuel ratio feedback control to be done following the acceleration. By thus setting the pulse motor to the preset position $PS_{ACC}$ at the standing start of the engine, it is feasible to reduce the amount of detrimental ingredients in the engine exhaust gases to be produced at the standing start. Further, this setting of the pulse motor position automatically determines the initial air/fuel ratio to be applied at the start of air/fuel ratio feedback control immediately following this standing start to thereby facilitate control of the air/fuel ratio to an optimum value for the emission characteristics and driveability of the engine at the start of air/fuel ratio feedback control.

Particularly, the above manner of control at engine acceleration enables a large reduction in the total amount of detrimental ingredients in the exhaust gases to be produced during transition from the standing start to the immediately following air/fuel ratio feedback operation, thus being advantageous to the anti-pollution measures.

In transition from the above-mentioned various open loop control to the closed loop control at engine partial load or vice versa, changeover between open loop mode and closed loop mode is effected in the following manner: First, in changing from closed loop mode to open loop mode, ECU 20 moves the pulse motor 13 to an atmospheric pressure-compensated predetermined position $PSi(P_A)$ in a manner referred to later, irrespective of the position at which the pulse motor was located immediately before entering the open loop control. This predetermined position $PSi(P_A)$ includes preset positions $PS_{CR}$, $PS_{WOT}$, $PS_{IDL}$, $PS_{DEC}$ and $PS_{ACC}$, each of which is corrected in response to actual atmospheric pressure as hereinlater referred to. Various open loop control operations can be promptly done, simply by setting the pulse motor to the above-mentioned respective predetermined positions.

On the other hand, in changing from open loop mode to closed loop mode, ECU 20 commands the pulse motor 13 to initiate air/fuel ratio feedback control with I term correction. That is, there can be a difference in timing between the change of the output signal level of the $O_2$ sensor from the high level to the low level or vice versa and the change from the open loop mode to the closed loop mode. In such an event, the deviation of the pulse motor position from the proper position upon entering the closed loop mode, which is due to such timing difference, is much smaller in the case of initiating air/fuel ratio control with I term correction than that in the case of initiating it with P term correction, to make it possible to resume early accurate air/fuel ratio control and accordingly ensure highly stable engine emissions.

To obtain optimum exhaust emission characteristics irrespective of changes in the actual atmospheric pressure during open loop air/fuel ratio control or at the time of shifting from open loop mode to closed loop mode, the position of the pulse motor 13 needs to be compensated for atmospheric pressure. According to the invention, the above-mentioned predetermined or preset positions $PS_{CR}$, $PS_{WOT}$, $PS_{IDL}$, $PS_{DEC}$, $PS_{ACC}$ at which the pulse motor 13 is to be held during the respective open loop control operations are corrected in a linear manner as a function of changes in the atmospheric pressure $P_A$, using the following equation:

$$PSi(P_A) = PSi + (760 - P_A) \times Ci$$

where i represents any one of CR, WOT, IDL, DEC and ACC, accordingly PSi represents any one of $PS_{CR}$, $PS_{WOT}$, $PS_{IDL}$, $PS_{DEC}$ and $PS_{ACC}$ at 1 atmospheric pressure (=750 mmHg), and Ci a correction coefficient, representing any one of $C_{CR}$, $C_{WOT}$, $C_{IDL}$, $C_{DEC}$ and $C_{ACC}$. The values of PSi and Ci are previously stored in ECU 20.

ECU 20 applies to the above equation the coefficients PSi, Ci which are determined at proper different values according to the kinds of open loop control to be carried out, to calculate by the above equation the position $PSi(P_A)$ for the pulse motor 13 to be set at a required kind of open loop control and moves the pulse motor 13 to the calculated position $PSi(P_A)$.

By correcting the air/fuel ratio during open loop control in response to the actual atmospheric pressure in the above-mentioned manner, it is possible to obtain not only conventionally known effects such as best driveability and prevention of burning of the ignition plug in an engine cylinder, but also optimum emission characteristics by setting the value of Ci at a suitable value, since the pulse motor position held during open loop control forms an initial position upon entering subsequent closed loop control.

The above atmospheric pressure compensation is carried out in response to the output of the pressure sensor 29 shown in FIG. 1. If this sensor 29 becomes inoperative due to its own defect, disconnection fault, a failure in ECU 20, etc., it is of course impossible to achieve proper atmospheric compensation. Further, if the air/fuel ratio control operation is continued even on such an occasion, the air/fuel ratio is controlled to an improper value due to an abnormal output of the sensor 29. According to the invention, to cope with such an expected accident, there are prescribed a normal atmospheric pressure range within which a vehicle would be placed under normal operating conditions, and an abnormal atmospheric pressure range which is outside the above normal range and within which the vehicle could never be placed under normal operating conditions. When the output value of the sensor 29 remains outside the above particular normal range for a predetermined period of time which is set at a value sufficient for exact judgement of whether or not a trouble occurs, for example, two seconds, the pulse motor 13 is immediately stopped, and if required, suitable actions are taken such as alarming and displaying the trouble, at the same time. Until the above period of time of two seconds lapses, the air/fuel ratio control operation so far carried out is continued by the use of an output value of the sensor 29 produced immediately before the occurrence of the abnormal output of the sensor 29.

The position of the pulse motor 13 which is used as the actuator for the air/fuel ratio control valve 9 is monitored by a position counter provided within ECU 20. However, there can occur a disagreement between the counted value of the position counter and the actual position of the pulse motor due to skipping or racing of the pulse motor. In such an event, ECU 20 operates on the counted value of the position counter as if it were the actual position of the pulse motor 13. However, this can impede proper setting of the air/fuel ratio during open loop control where the actual position of the pulse motor 13 must be accurately recognized by ECU 20.

In view of the above disadvantage, according to the air/fuel ratio control system of the invention, in addition to detection of the initial position of the pulse motor 13 by regarding as the reference position (e.g., 50th step) the position of the pulse motor at which the reed switch 23 turns on or off when the pulse motor is driven, which was previously noted with reference to the initialization, the position counter has its counted value replaced by the number of steps corresponding to the reference position (e.g., 50 steps) stored in ECU 20 upon the pulse motor 13 passing the switching point of the reed switch 23, to thus ensure high reliability of subsequent air/fuel ratio control.

Figure 2:
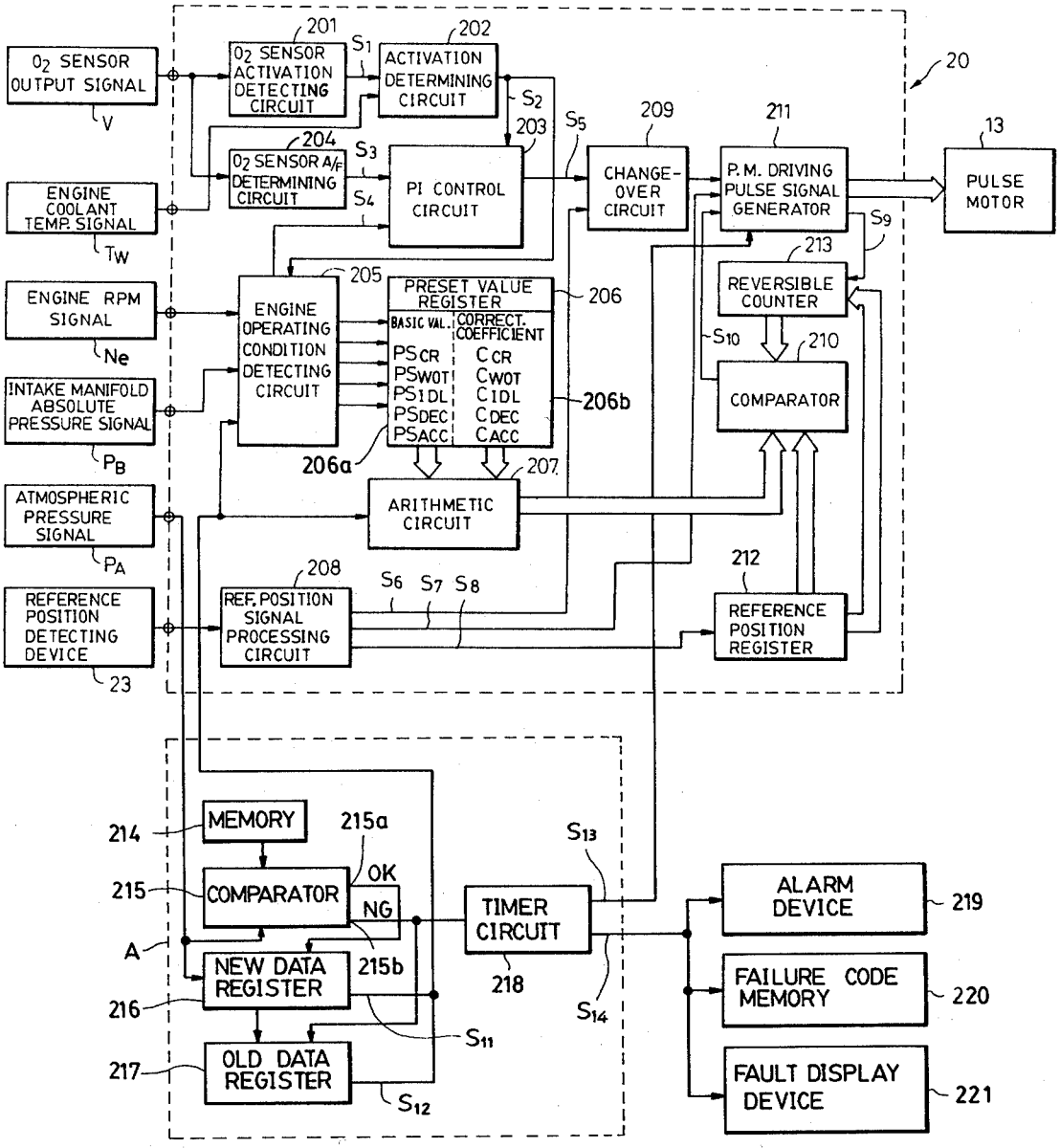
FIG. 2 is a block diagram illustrating the electrical circuit in the electronic control unit shown in FIG. 1.

FIG. 2 is a block diagram illustrating the interior construction of ECU 20 used in the air/fuel ratio control system having the above-mentioned functions according to the invention. In ECU 20, reference numeral 201 designates a circuit for detecting the activation of the $O_2$ sensor 28 in FIG. 1, which is supplied at its input with an output signal V from the $O_2$ sensor. Upon passage of the predetermined period of time Tx after the voltage of the above output signal V has dropped below the predetermined value Vx, the above circuit 201 supplies an activation signal $S_1$ to an activation determining circuit 202. This activation determining circuit 202 is also supplied at its input with an engine coolant temperature signal Tw from the thermistor 33 in FIG. 1. When supplied with both the above activation signal $S_1$ and the coolant temperature signal Tw indicative of a value exceeding the predetermined value Twx, the activation determining circuit 202 supplies an air/fuel ratio control initiation signal $S_2$ to a PI control circuit 203 to render same ready to operate. Reference numeral 204 represents an air/fuel ratio determining circuit which determines the value of air/fuel ratio of engine exhaust gases, depending upon whether or not the output voltage of the $O_2$ sensor 28 is larger than the predetermined value Vref, to supply a binary signal $S_3$ indicative of the value of air/fuel ratio thus obtained, to the PI control circuit 203. On the other hand, an engine condition detecting circuit 205 is provided in ECU 20, which is supplied with an engine rpm signal Ne from the engine rpm sensor 35, 36, an absolute pressure signal $P_B$ from the pressure sensor 31, an atmospheric pressure $P_A$ from the atmospheric pressure sensor 29, all the sensors being shown in FIG. 1, and the above control initiation signal $S_2$ from the activation determining circuit 202 in FIG. 2, respectively. The circuit 205 supplies a control signal $S_4$ indicative of a value corresponding to the values of the above input signals to the PI control circuit 203. The PI control circuit 203 accordingly supplies to a change-over circuit 209 to be referred to later a pulse motor control signal $S_5$ having a value corresponding to the air/fuel ratio signal $S_3$ from the air/fuel ratio determining circuit 204 and a signal component corresponding to the engine rpm Ne in the control signal $S_4$ supplied from the engine condition detecting circuit 205. The engine condition detecting circuit 205 also supplies to the PI control circuit 203 the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine condition detecting circuit 205, the PI control circuit 203 interrupts its own operation. Upon interruption of the supply of the above signal component to the control circuit 203, a pulse signal $S_5$ is outputted from the circuit 203 to the change-over circuit 209, which signal starts air/fuel ratio control with integral term correction. A preset value register 206 is provided in ECU 20, in which are stored the basic values of preset values $PS_{CR}$, $PS_{WOT}$, $PS_{IDL}$, $PS_{DEC}$ and $PS_{ACC}$ for the pulse motor positions, applicable to various engine conditions, and atmopsheric pressure correcting coefficients $C_{CR}$, $C_{WOT}$, $C_{IDL}$, $C_{DEC}$ and $C_{ACC}$ for these basic values. The engine condition detecting circuit 205 detects the operating condition of the engine based upon the activation of the $O_2$ sensor and the values of engine rpm Ne, intake manifold absolute pressure $P_B$ and atmospheric pressure $P_A$ to read from the register 206 the basic value of a preset value corresponding to the detected operating condition of the engine and its corresponding correcting coefficient and apply same to an arithmetic circuit 207. The arithmetic circuit 207 performs arithmetic operation responsive to the value of the atmospheric pressure signal $P_A$, using the equation $PSi(P_A)=-PSi+(760-P_A)\times Ci$. The resulting preset value is applied to a comparator 210.

On the other hand, a reference position signal processing circuit 208 is provided in ECU 20, which is responsive to the output signal of the reference position detecting device (reed switch) 23, indicative of the switching of same, to produce a binary signal $S_6$ having a certain level from the start of the engine until it is detected that the pulse motor reaches the reference position. This binary signal $S_6$ is supplied to the change-over circuit 209 which in turn keeps the control signal $S_5$ from being transmitted from the PI control circuit 203 to a pulse motor driving signal generator 211 as long as it is supplied with this binary signal $S_6$, thus avoiding the interference of the operation of setting the pulse motor to the initial position with the operation of P-term/I-term control. The reference position signal processing circuit 208 also produces a pulse signal $S_7$ in response to the output signal of the reference position detecting device 23, which signal causes the pulse motor 13 to be driven in the step-increasing direction or in the step-decreasing direction so as to detect the reference position of the pulse motor 13. This signal $S_7$ is supplied directly to the pulse motor driving signal generator 211 to cause same to drive the pulse motor 13 until the reference position is detected. The reference position signal processing circuit 208 produces another pulse signal $S_8$ each time the reference position is detected. This pulse signal $S_8$ is supplied to a reference position register 212 in which the value of the reference position (e.g., 50 steps) is stored. This register 212 is responsive to the above signal $S_8$ to apply its stored value to one input terminal of the comparator 210 and to the input of a reversible counter 213. The reversible counter 213 is also supplied with an output pulse signal $S_9$ produced by the pulse motor driving signal generator 211 to count the pulses of the signal $S_9$ corresponding to the actual position of the pulse motor 13. When supplied with the stored value from the reference position register 212, the counter 213 has its counted value replaced by the value of the reference position of the pulse motor.

The counted value thus renewed is applied to the other input terminal of the comparator 210. Since the comparator 210 has its other input terminal supplied with the same pulse motor reference position value, as noted above, no output signal is supplied from the comparator 210 to the pulse motor driving signal generator 211 to thereby hold the pulse motor at the reference position with certainty. Subsequently, when the $O_2$ sensor 28 remains deactivated, an atmospheric pressure-compensated preset value $PS_{CR}(P_A)$ is outputted from the arithmetic circuit 207 to the one input terminal of the comparator 210 which in turn supplies an output signal $S_{10}$ corresponding to the difference between the preset value $PS_{CR}(P_A)$ and a counted value supplied from the reversible counter 213, to the pulse motor driving signal generator 211, to thereby achieve accurate control of the position of the pulse motor 13. Also, when the other open loop control conditions are detected by the engine condition detecting circuit 205, similar operations to that just mentioned above are carried out.

In FIG. 2, symbol A designates a block for performing a fail safe function. In this block A, reference numeral 214 designates a limit value memory in which are stored values indicative of upper and lower limits of atmospheric pressure. The upper and lower limits delimit a normal range within which a vehicle carrying the engine concerned would be placed when it is driven under normal operating conditions. The memory 214 is arranged to supply its stored values to a limit value comparator 215 at its one input terminal, which has its other input terminal arranged to be supplied directly with the atmospheric pressure signal $P_A$. This atmospheric pressure signal $P_A$ is also applied to and stored in a new data register 216 as the value of the atmospheric pressure signal $P_A$ as of the present time. The stored data in the new data register 216 are successively transferred to and stored in an old data register 217 as the atmospheric pressure value occurring immediately before the above new value $P_A$. Both of the registers 216, 217 have their outputs connected to the engine operating condition detecting circuit 205 and the arithmetic circuit 207 so that the values $S_{11}$, $S_{12}$ stored in the registers 216, 217 are supplied to the circuits 205, 207, depending upon the output signal of the comparator 215 in a manner described later. The limit value comparator 215 has two output terminals **215*a*, 215*b*, the one terminal 215*a* being connected to the new data register 216, and the other terminal 215*b* to the old data register 217 and a timer circuit 218, respectively. The timer circuit 218 is arranged to produce fault signals $S_{13}$, $S_{14}$ upon passage of a predetermined period of time (e.g., 2 seconds) after application of the output signal of the comparator 215 thereto. The timer circuit 218 has an output thereof connected to the pulse motor driving signal generator 211 to supply the output signal $S_{13}$ thereto for interruption of the operation of same, and another output thereof connected to an alarm device 219, a failure code memory 220 and a fault display device 221** to supply the output signal $S_{14}$ for actuation of these devices.

The operation of the fail safe block A for the atmospheric pressure sensor, arranged above, will now be described. The atmospheric pressure signal $P_A$ is outputted from the atmospheric pressure sensor 29 to the comparator 215 which in turn compares the value of the signal $P_A$ with the upper and lower limits of atmospheric pressure supplied from the limit value memory 214. When the value of the signal $P_A$ falls within the range between the upper limit and the lower limit, the comparator 215 supplies an OK signal through its output terminal **215*a* to the new data register 216 to have its stored atmospheric pressure value as of the present time outputted to the engine operating condition detecting circuit 205 and the arithmetic circuit 207. The circuits 205, 207** operate on the present atmospheric pressure to carry out air/fuel ratio control operation in the aforementioned manner.

When the value of the atmospheric pressure signal $P_A$ changes out of the range between the upper and lower limits of atmospheric pressure, the comparator 215 supplies an NG signal through its output terminal **215*b* to the old data register 217 to interrupt replacement of the data stored in the old data register 217 with data in the new data register 216 and simultaneously have the stored atmospheric pressure value occurring immediately before the occurrence of the NG signal outputted from the register 217 to the above circuits 205, 207. Thus, the circuits 205, 207 operate on this old atmospheric pressure value to carry out air/fuel ratio control operation in the aforementioned manner. At the same time, the above NG signal outputted from the comparator 215 is supplied to the timer circuit 218**, too.

The timer circuit 218, on one hand, produces the signal $S_{13}$ when the supply of the NG signal thereto is continued for the predetermined period of time (2 seconds) and supplies it to the pulse motor driving signal generator 211 to interrupt its operation immediately, and on the other hand, produces and supplies the signal $S_{14}$ to the alarm device 219, the failure code memory 220 and the fault display device 221 for respective predetermined actions. Incidentally, the timer circuit 218 is adapted to stop its counting action and accordingly produce neither of the signals $S_{13}$, $S_{14}$ if the supply of the NG signal to the timer circuit 218 is interrupted before the lapse of the predetermined of time (2 seconds).

During the interval between the occurrence of the NG signal and the lapse of the above predetermined period of time, the air/fuel ratio control operation is continued by the use of the signal $S_{12}$ outputted from the old data register 217, representing the old atmospheric pressure value occurring immediately before the present time.

What is claimed is:

1. An air/fuel ratio control system for performing feedback control of the air/fuel ratio of a mixture being supplied to an internal combustion engine, which comprises: an $O_2$ sensor for detecting the concentration of oxygen present in exhaust gases emitted from said engine; fuel quantity adjusting means for producing said mixture being supplied to said engine; and an electrical circuit operatively connecting said $O_2$ sensor with said fuel quantity adjusting means in a manner effecting feedback control operation in response to an output signal produced by said $O_2$ sensor to control the air/fuel ratio of said mixture to a first predetermined preset value, said electrical circuit including means for interrupting said feedback control operation when said engine comes into a predetermined operating condition, means responsive to said interruption of said feedback control operation to control said fuel quantity adjusting means so as to obtain an air/fuel ratio of said mixture equal to a second predetermined preset value corresponding to said predetermined engine operating condition irrespective of the value of the output signal of said $O_2$ sensor, and means for correcting said second predetermined preset value as a function of atmospheric pressure.

2. An air/fuel ratio control system for performing feedback control of the air/fuel ratio of a mixture being supplied to an internal combustion enging, which comprises: an $O_2$ sensor for detecting the concentration of oxygen present in exhaust gases emitted from said engine; fuel quantity adjusting means for producing said mixture being supplied to said engine; an electrical circuit operatively connecting said $O_2$ sensor with said fuel quantity adjusting means in a manner effecting feedback control operation in response to an output signal produced by said $O_2$ sensor to control the air/fuel ratio of said mixture to a first predetermined preset value; a sensor for detecting atmospheric pressure to produce an output indicative thereof, and means for detecting operating conditions of said engine; wherein said electrical circuit including: first memory means storing a second predetermined preset value as a basic value of the air/fuel ratio of said mixture corresponding to a predetermined operating condition of said engine at a predetermined value of atmospheric pressure; second memory means storing a coefficient for providing a correction value corresponding to the difference between said predetermined value of atmospheric pressure and the value of actual atmospheric pressure; means for arithmetically calculating the sum of said basic value+(the value of actual atmospheric pressure−said predetermined value of atmospheric pressure)×said correction coefficient; third memory means for storing said sum calculated by said arithmetic calculating means; and means responsive to said sum stored in said third memory means for controlling said fuel quantity adjusting means when said enging condition detecting means detects said predetermined engine operating condition.

3. The air/fuel ratio control system as claimed in claim 2, wherein said electrical circuit further includes: fourth memory means storing predetermined upper and lower limit values of an output which can be produced by said atmospheric pressure sensor at said predetermined value of atmospheric pressure; fifth memory means for storing an actual output of said atmospheric pressure sensor; means for comparing said actual output of said atmospheric pressure sensor with said upper and lower limit values to apply said actual output to said fifth memory means for storage therein when said actual output is within a range between said upper and lower limit values and produce a first signal when said actual output of said atmospheric pressure sensor is outside said range; means for applying said actual output stored in said fifth memory means to said arithmetic calculating means; timer means for producing a second signal when said first signal is continuously supplied thereto for a predetermined period of time; alarm means operable on said second signal; and means responsive to said first signal to hold said actual output stored in said fifth memory means at a value occurring immediately before said second signal is supplied thereto.

4. The air/fuel ratio control system as claimed in claim 2, wherein said electrical circuit further includes: fourth memory means storing predetermined upper and lower limit values of an output which can be produced by said atmospheric pressure sensor at said predetermined value of atmospheric pressure; fifth memory means for storing an actual output of said atmospheric pressure sensor; means for comparing said actual output of said atmospheric pressure sensor with said upper and lower limit values to apply said actual output to said fifth memory means for storage therein when said actual output is within a range between said upper and lower limit values and produce a first signal when said actual output of said atmospheric pressure sensor is outside said range; means for applying said actual output stored in said fifth memory means to said arithmetic calculating means; timer means for producing a second signal when said first signal is continuously supplied thereto for a predetermined period of time; means responsive to said second signal to memorize and display a fault concerned; and means responsive to said first signal to hold said actual output stored in said fifth memory means at a value occurring immediately before said second signal is supplied thereto.

5. The air/fuel ratio control system as claimed in claim 2, wherein said electrical circuit further includes: fourth memory means storing predetermined upper and lower limit values of an output which can be produced by said atmospheric pressure sensor at said predetermined value of atmospheric pressure; fifth memory means for storing an actual output of said atmospheric pressure sensor; means for comparing said actual output of said atmospheric pressure sensor with said upper and lower limit values to apply said actual output to said fifth memory means for storage therein when said actual output is within a range between said upper and lower limit values and produce a first signal when said actual output of said atmospheric pressure sensor is outside said range; means for applying said actual output stored in said fifth memory means to said arithmetic calculating means; timer means for producing a second signal when said first signal is continuously supplied thereto for a predetermined period of time; means responsive to said second signal to hold the operation of said fuel quantity adjusting means at one occurring immediately before said second signal is supplied thereto; and means responsive to said first signal to hold said actual output stored in said fifth memory means at a value occurring immediately before said second signal is supplied thereto.

6. An air/fuel ratio control system for performing feedback control of the air/fuel ratio of a mixture being supplied to an internal combustion engine, comprising:

an $O_2$ sensor for detecting the concentration of oxygen present in exhaust gases emitted from said engine;

fuel quantity adjusting means for producing said mixture being supplied to said engine;

a sensor for detecting atmospheric pressure to produce an output indicative thereof;

means for detecting operating conditions of said engine; and an electrical circuit operatively connecting said $O_2$ sensor with said fuel quantity adjusting means in a manner effecting feedback control operation in response to an output signal produced by said $O_2$ sensor to control the air/fuel ratio of said mixture to a first predetermined preset value, said electrical circuit including:

first memory means storing a plurality of different second predetermined preset values as basic values of the air/fuel ratio of said mixture individually corresponding to respective ones of different predetermined operating conditions of said enging at a predetermined value of atmospheric pressure;

second memory means storing a plurality of different coefficients having predetermined values individually corresponding to respective ones of said predetermined operating conditions of said engine, for providing respective correction values corresponding to the difference between said predetermined value for atmospheric pressure and the value of actual atmospheric pressure;

calculating means operable when said engine operating condition detecting means detects one of said different predetermined operating conditions of said engine, to arithmetically calculate the sum of (i) one of said basic values corresponding to said detected one predetermined operating condition of said engine and (ii) the product of the value of actual atmospheric pressure less said predetermined value of atmospheric pressure with one of said coefficients corresponding to said detected one predetermined operating condition of said engine; and means responsive to said sum calculated by said calculating means for controlling said fuel quantity adjusting means.

* * * * *